US005275021A

United States Patent [19]

Fucik

[11] Patent Number: 5,275,021

[45] Date of Patent: Jan. 4, 1994

[54] CIRCULAR KNITTING MACHINE

[75] Inventor: Milan Fucik, Kojetice na Morave, Czechoslovakia

[73] Assignee: Uniplet s.a., Trebic, Czechoslovakia

[21] Appl. No.: 993,413

[22] Filed: Dec. 21, 1992

[30] Foreign Application Priority Data

Dec. 30, 1991 [CS] Czechoslovakia ..... 4125-91

[51] Int. Cl.[5] ..... D04B 15/82

[52] U.S. Cl. ..... 66/57; 66/9 R; 66/14; 66/216; 66/219

[58] Field of Search ..... 66/9; 66/13; 66/14; 66/15; 66/51; 66/57; 66/216; 66/217; 66/219; 66/220; 66/221; 66/43

[56] References Cited

U.S. PATENT DOCUMENTS

| | | | |
|---|---|---|---|
| 3,136,145 | 6/1964 | Coile | 66/43 |
| 3,186,192 | 6/1965 | Schmidt | 66/216 |
| 4,151,729 | 5/1979 | Micheletti | 66/216 |
| 4,739,636 | 4/1988 | Manini | 66/220 |
| 4,827,740 | 5/1989 | Cottenceau et al. | 66/219 X |
| 4,875,347 | 10/1989 | Vermot-Gaud et al. | 66/219 |
| 5,167,133 | 12/1992 | Schmidt | 66/9 R |
| 5,174,131 | 12/1992 | Cottenceau et al. | 66/219 X |

FOREIGN PATENT DOCUMENTS

| | | | |
|---|---|---|---|
| 2705672 | 8/1977 | Fed. Rep. of Germany | 66/14 |
| 2724633 | 1/1978 | Fed. Rep. of Germany | 66/14 |
| 930805 | 7/1963 | United Kingdom | 66/14 |
| 1501646 | 2/1978 | United Kingdom | 66/14 |

*Primary Examiner*—Clifford D. Crowder
*Assistant Examiner*—John J. Calvert
*Attorney, Agent, or Firm*—Notaro & Michalos

[57] ABSTRACT

A circular knitting machine for manufacturing hosiery comprises a lower needle cylinder (1) having a cam section arrangement (5, 6, 7, 8, 9) and a verticle trick (2) grooved on the needle cylinder (1) near the arrangement (5, 6, 7, 8, 9). The cam section arrangement (5, 6, 7, 8, 9) defines a plurality of channels (13, 14, 15, 16). A sinker arrangement (3, 4) is disposed in the verticle trick (2) for verticle movement and has guiding butts (41, 42) alternately engageable with the channels (13, 14, 15, 16). The guiding butts (41, 42) are movable in the channels (13, 14, 15, 16) in a knitting direction (S) and a reverse knitting direction (S'). A plurality of needles (4') are engaged with the sinker arrangement (3, 4). Stitch cams (10, 11) are mounted to the cam section arrangement (5, 6, 7, 8, 9) for engaging the needle (4') when the needles (4') are moved in the knitting direction (S). A reverse stitch cam (12) is mounted to the cam section arrangement (5, 6, 7, 8, 9) for engaging the needles (4') when the needles (4') are moved in the reverse knitting direction (S').

2 Claims, 2 Drawing Sheets

CIRCULAR KNITTING MACHINE

FIELD AND BACKGROUND OF THE INVENTION

The invention relates to circular knitting machines, especially machines for manufacturing hosiery or the like, that are provided with latch needles mounted in a needle cylinder. In operation, the needles are lowered and lifted by means of swinging sinkers which are provided with two guiding butts alternately engageable with cam channels. Alternatively, the butts can be provided immediately on the needles, or on guiding sinkers of double-head needles.

Circular knitting machines provided with swinging sinkers having two guiding butts are well known. These machines are adapted for reverse knitting operations, such as knitting heels and toes of hosiery, and particularly in a single feed system. The system is usually provided with a right and left sinking cam as well as with heel cam which is designed for displacing the needles onto the level of the sinking cams, i.e. in both knitting directions. Due to such an arrangement, the cam channels for the butts of the needles or for the needle guiding sinkers cross each other. Below the heel cam there is provided a compensating cam which is designed for positioning the needles and for preventing the needles form assuming, owing to the knitting speed, a position which is lower than the position which is necessary for laying thread into the needles. Consequently, the needle races are broken, and the guiding butts are exposed to many shocks which causes paths to lose their curvilinear course. The motion, especially with double-cylinder machines, is ensured within a section, by the lower butts of the guiding sinkers so that even the race continuity is impaired. Therefore, any increase in knitting speed is difficult.

SUMMARY OF THE INVENTION

It is an object of the present invention to eliminate the drawbacks of the prior art devices as referred to above and to provide an improved circular knitting machine for manufacturing hosiery having latch needles which are mounted in a lower needle cylinder. When operated, the latch needles are lowered and lifted by swinging sinkers provided with two guiding butts, i.e. a first guiding butt and a second guiding butt, which are alternately engageable with cam channels and which can be provided either directly on the needles, or on the swinging sinkers when received in vertical tricks of the lower needle cylinder.

According to the present invention, at least one first sinking cam, is provided in the cam channel for the first guiding butts which provides a rotational knitting direction. Second guiding butts in the cam channel have at least one second sinking cam or at least one third sinking cam for providing a reverse knitting direction. In the cam channel of the second guiding butts, there are provided cam means for transferring the needles from knitting paths into and out of an elevated heel path. The cam means comprises three shaped grooves which have at their ends chamferings for forcing the second guiding butts into the vertical tricks of the needle cylinder. Above the starting point of each groove, there is proved a swinging push-button. While in the cam channel for the first guiding butts, there are provided means for reducing and adding needles when in the reverse knitting operation. The means comprising a shaped through groove having at its end a chamfering for forcing the first guiding butts into the vertical tricks of the needle cylinder, and a radially movable push-button being provided above the starting point of said shaped through groove. The cam channels for guiding the first and the second guiding butts are separate from each other for both knitting directions.

DESCRIPTION OF THE PREFERRED EMBODIMENTS

Figures 1, 2:
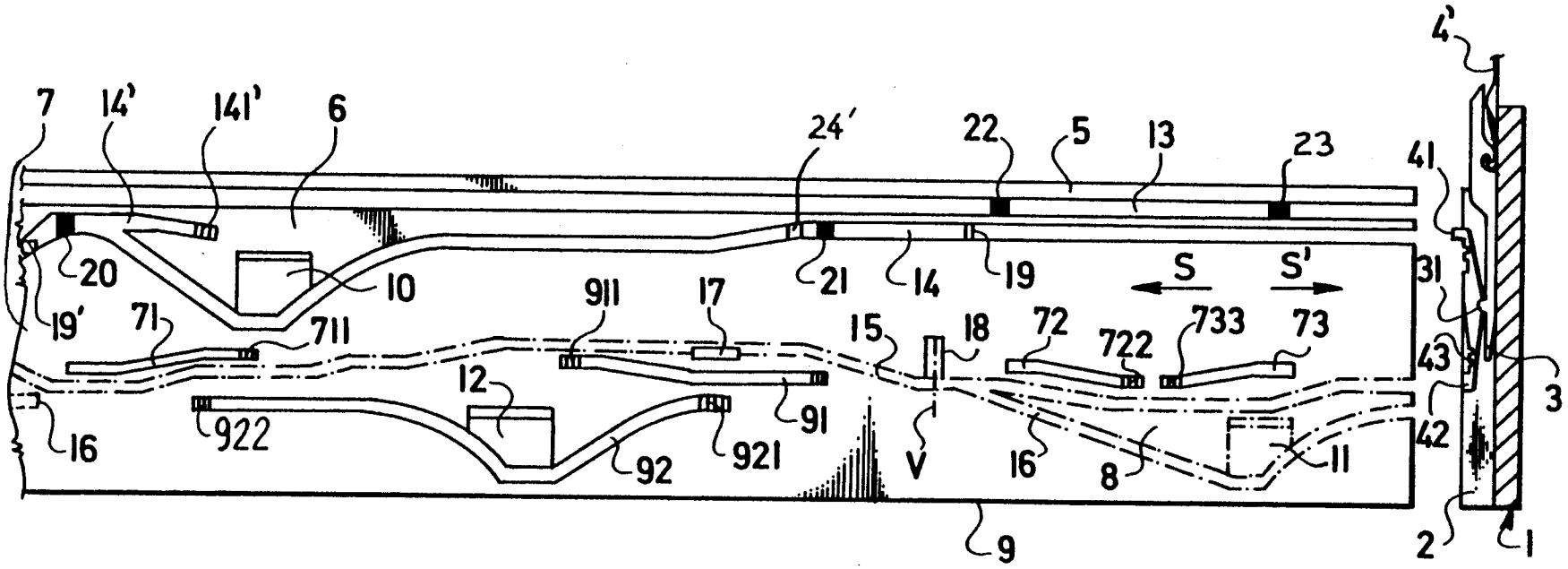
FIG. 1 is a partial view of cam section arrangement according to the present invention.
FIG. 2 is a sectional view of a lower needle cylinder having guiding butts and swinging butts.

As illustrated in FIG. 2, the present invention pertains to a double-cylinder circular knitting machine designed for manufacturing ribbed goods and hosiery, and comprises an upper needle cylinder (not shown) and a lower needle cylinder 1 having vertical tricks 2. Vertical tricks 2 of said lower needle cylinder 1 receive guiding sinkers 3 of needles 4'. The needles 4' are of a double-head latch type which allows for the transfer to the upper needle cylinder for knitting link-to-link stitches. By means of a joint 31, each guiding sinker 3 carries a swinging sinker 4 having one first and one second guiding butt 41 and 42, respectively, as well as pattern butts 43. The cam system of the lower needle cylinder 1 consists of five cam sections 5, 6, 7, 8 and 9. In the cam section 6, there is mounted, for vertical motion, a first sinking cam 10 for engaging the needle 4' in a rotational knitting direction S. In cam section 8, a second vertically movable sinking cam 11 is provided for engaging needles 4' in the rotational knitting direction S. Finally, in the cam section 9 there is disposed a third sinking cam 12 for engaging needles 4' in a reverse knitting direction S'.

The cam sections 5 and 6, when assembled together, form a channel 13 for first guiding butts 41 of the swinging sinkers 4. The channel 13 forms the work race for needles 4' of the first knitting system for forming stitches in the rotational knitting direction S. A shaped through groove 14' serves for guiding the first guiding butts 41 in the reverse knitting direction S' and terminates in a chamfering 141' for forcing the first guiding butts 41 into the vertical tricks 2 of the lower needle cylinder 1. In the cam section 7, there are provided three shaped through grooves 71, 72 and 73 in the path of the second guiding butts 42. The groove 71 is designed for transferring the needles 4' from the knitting position into a heel forming position during the reverse direction S' of rotation. A starting point of the groove 71 corresponds to a clearing position of the needle 4', and the end portion to the heel position. At its end, the groove 71 has a chamfering 711 for forcing the second guiding butts 42 into the vertical tricks 2 of the needle cylinder 1. The shaped through groove 72 serves for transferring the needles 4' back from the heel position into the knitting position during the reverse knitting direction S'. The starting point of the groove 72 corresponds to the heel position of the needle 4' while the end portion corresponds to the clearing position. The end portion of the groove 72 has a chamfering 722 for forcing the second guiding butts 42. Finally, the third shaped through groove 73 forms a mirror image of the groove 72 and serves the same purpose as groove 72. At the end of the groove 73 there is also a chamfering 733 for forcing the second guiding butts 42.

The cam sections 8, 9 and 7 form a channel 15 for guiding the second guiding butts 42 as to a height corresponding to that of the guiding sinkers 3 when the points of the sinkers 3 open the latches of the upper needles 4'; alternatively, the channel 15 can serve for transferring the needles 4' between the upper and lower needle cylinders.

The cam sections 8 and 9 form a channel 16 within the path of the second guiding butts 42 for the stitch-forming motion of needles 4' in a second knitting system. During the rotational knitting direction S, a portion of the channel 16 is in the cam section 9. There is also a shaped through groove 91, constituting a mirror image of the groove 71 and having, a chamfering 911, for reducing the number of needles for the rotational knitting direction S. Further, in the cam section 9, there is formed, within the path of the second guiding butts 42, a shaped through groove 92 which provides the needles 4' with a stitch-forming motion in the reverse knitting direction S', and partially in the knitting direction S. The groove 92 terminates at its ends by chamferings 921 and 922 designed for forcing the second guiding butts 42. In the transfer point there is provided in the cam section 9 a through groove for the push-button 17.

Figure 3:
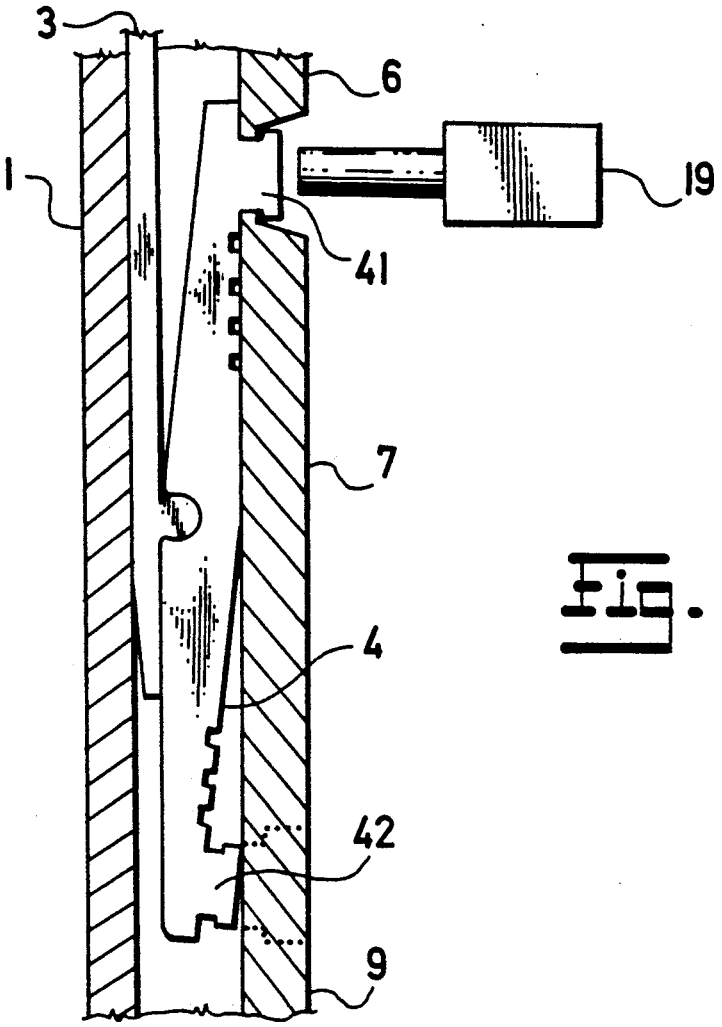
FIG. 3 is a sectional view of a cam block and a swinging sinker together with a push-button.
Figure 4:
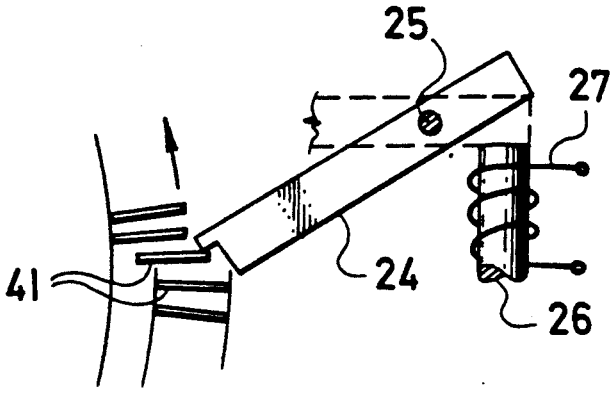
FIG. 4 is a view showing a swinging push-button in operation according to the present invention.

In a choice point V of the needles 4' (indicated by dot-and-dash line) there is provided in the cam section 7 a vertical groove 18 designed for being engaged by swinging levers of a known selecting means (not shown), in which levers, in inoperative positions, enter the space between pattern butts 43. While in their operative positions, they engage the paths of butts 43. Upstream of the choice point V, there is provided in the path of the first butts 41, a radially movable push-button 19 which, enters, in an operative position, the channel 14. Downstream of the choice point V, there is provided radially movable push-button 24'. Above the starting point of the channel 16 there is further provided within the path of the first guiding butts 41, in the channel 14, a radially movable push-button 19'. Above the starting points of the shaped through grooves, there are provided, at the height of the channel 13 or the channel 14, respectively, four swinging push-buttons 20, 21, 22, 23. Each of the push-buttons 20, 21, 22, and 23 consist of a swinging presser lever 24 (FIG. 3) which is spring-loaded by a torsion spring provided about its pivot. The swinging presser lever 24 is arranged on a carrier 25 fixedly supporting a permanent magnet 26 together with a coil 27 connected to a controlling computer (not shown). The carrier 25 is arranged radially movable to the needle cylinder 1.

In operation, during the rotational knitting, the swinging push-buttons 20, 21, 22, 23 and 24' are removed from the needle cylinder into non-operative positions and radially movable push-button 19 and 19 are situated within the path of the first guiding butts 41 in the channel 14 so that they cause engagement of the guiding butts 41 in front of the choice point V. The guiding levers of the guiding means (according to a program) causes a pressure to the pattern butts 43 so that the swinging sinkers 4 follow, by their first guiding butts 41', the path of the channel 14 so that the guiding sinkers 3 and the corresponding needles 4' form face stitches in the fabric. By the radially movable or approaching push-button 19', the first guiding butts 41 are forced into the lower needle cylinder 1 while the second guiding butts 42 are swung into the channel 16. The needles 4' form face stitches in the second knitting system or on the second sinking cam 11 whereupon the guiding sinkers 3 are displaced again to the position in front of the choice point V or the radially movable push-button 19. The swinging sinkers 4, whose pattern butts 43 have not been forced into the needle cylinder 1, are guided, by means of their second guiding butts 42, in the channel 15. By the push-button 17, the guiding sinkers 3 together with the needles 4' are disengaged so that the needles 4' are transferred between the two needle cylinders, provided the needles in the upper needle cylinder are also brought into the transfer position. The empty guiding sinkers 3 pass by means of the first guiding butts 41 through the channel 15 up to the choice point V. The needles 4', once transferred onto the upper needle cylinder, form back stitches.

The heel or the toe of a hose, by the reverse motion of the needle cylinders, is formed in the following way listed below.

The needles 4' are separated in the lower needle cylinder into operating and non-operating needles as follows. By the selecting device all of the pattern butts 43 are pressed in. The radially movable push-button 24' is brought to the lower needle cylinder 1 in that section only which corresponds to the heel-forming needles 4'. The radially movable push-button 24' will press in the first guiding butts 41 so that the second guiding butts 42 get into the shaped through groove 91 where they are raised and pressed in again by the chamfering 911. The first guiding butts 41 are received by the channel 13, and the corresponding guiding sinkers 3 or needles 4', respectively, assume an elevated heel position with stitches on the needle stems below the needle latches. The other needles 4' knit in the first knitting regime or system while the radially movable or approaching push-buttons 19 and 19' are removed from the lower needle cylinder whereby the second knitting system is set out of operation. Meanwhile the machine is given reverse motion, and the swinging push-buttons 20 and 21 are brought to the lower needle cylinder 1. The operating needles 4' are in the clearing position, which means that the first guiding butts 41 are in the channel 14. Prior to changing the rotational knitting direction S into the reverse knitting direction S', there is effected the first stitch reducing or narrowing phase by means of the swinging push-button 21 which can force only one first guiding butt 41. The swinging push-button 21 or 20, operate in such way that the first guiding butt 41, owing to friction, carries along the swinging presser lever 24 which swings into a space between the adjacent lever 24 which swing into a space between the adjacent first guiding butts 41 so that the next first guiding butt 41 swings up to the permanent magnet 26 by attraction whereas the other first guiding butts 41 are allowed to pass and are pressed in the further narrowing phases. In this phase, the swinging presser lever 24 of the swinging push-button 21 is held by the permanent magnet 26. By pressing the first guiding butt 41, the corresponding second guiding butt 42 is pressed out into the shaped through groove 91 while, during the further rotation, it strikes the chamfering 911 whereby the first guiding butt 41 is tilted out backward into the channel 13, i.e. into an inoperative height or position. Thus the corresponding guiding sinker 3 and the needle 4' are displaced into the heel-forming position. During this rotation direction, the swinging presser lever 24 of the swinging push-button 20 is held by the permanent magnet 26. When changing the rotational directions to the reverse direction S', the first guiding butts 41 are led through the channel 14 up to the shaped through groove 14' where they are pressed in by the chamfering 141'. The second guiding butts 42 of the swinging sinkers 4 are titled out into the shaped through groove 92, and the corresponding needles 4' form stitches in the first knitting system in the reverse knitting direction S' on the third sinking cam 12. After the stitch formation, the needles 4' are raised into the clearing position while the chamfering 921 will press in the second guiding butts 42 into the vertical tricks 2, and the first guiding butts 41 enter the channel 14. The group of operating needles 4' is then led by means of the channel 14 up to the dead point, i.e. the point where the swinging sinker stops before turning in the opposite direction for reverse knitting, while before the latter, the needle 4' or the guiding sinker 3, respectively, is eliminated from this group into the heel-forming position by the swinging push-button 20, and particularly in the same way as described with the swinging push-button 21, which means by the shaped through groove 71 and the chamfering 711. A part of the first guiding butts 41 belonging to the corresponding operating needles 4', upstream of the dead point, is led again through the shaped through groove 4' and is pressed in by the chamfering 141', and further on the guiding sinkers 3 are led up to the dead point by the second guiding butts 42 in the shaped through groove 2. Downstream of the dead point, during the rotational knitting direction S, the second guiding butts 42 are pressed in by the chamfering 922, and the guiding sinkers 3 are led by means of the first guiding butts 41. After the winding of coil 27 has been supplied with current, the permanent magnet 26 will release the swinging presser lever 24 of swinging push-button 21 which, due to the force of torsion spring, reassumes its initial position whereupon the next removal of the needle 4' can be affected as hereinabove described. After the reduction of the predetermined number of needles 4' has ended, the knitting of the second heel portion is effected in the following way while the heel-forming needles 4' are being added again.

The swinging push-buttons 22 and 23 are set in operation; these, however, are shaped so that their swinging presser levers have a larger working front whereby they gradually press in the two first guiding butts 41. Otherwise, their function remains the same. These swinging butts 22 and 23 alternately press in the first guiding butts 41 from both sides of the group of swinging sinkers 4 belonging to the guiding sinkers 3 or to the needles 4', respectively, in the elevated heel-forming position. In this way, the second guiding butts 42 are titled out into the shaped through grooves 72 or 73, respectively, and are pressed in again by the chamferings 722 and 733 so that their first guiding butts 41 are tilted out again into the channel 14, and the needles 4' are transferred in this way back to the knitting position. Simultaneously, however, the swinging push-buttons 20 and 21 are in operation, which results again in adding only one needle 4' in each of the two knitting directions. After the needle adding has ended, the swinging push-button 20, 21, 22 and 23 are displaced away from the lower needle cylinder 1, and the knitting machine continues its rotational operation as described above.

Within the scope of the present invention, it is possible to provide the swinging sinkers 4 immediately on the needle stems for single-cylinder knitting machines manufacturing hosiery with reverse heel or toe, respectively, or with single-cylinder machines for creating the so-called, intarsia designs on calf, by means of reverse knitting, without effecting the subject matter of the invention.

Needless to say, the invention can be applied to a machine with a plurality of knitting systems operating either in the reverse or rotational regime. The sinking cams of the knitting systems in the rotational operation can be provided only within the path of one type of guiding butts, which is preferable with single-cylinder machines, or in the paths of both guiding butt types, depending on the knitting technologies applied to the machine. However, for the reverse operation, the sinking cams for the rotational and the reverse direction of knitting S and S', respectively, are always disposed in the grooves of the first and the second guiding butts 41 and 42, respectively.

Further, in lieu of the swinging push-buttons, it is possible to use only radially movable push-buttons or any other means for pressing in the corresponding guiding butts, such as a well-known electric motor with reverse rotation so that the swing extent can be controlled by means of a microcomputer. Such means for pressing in the guiding butts would be, in the reverse regime, fixedly attached whereas the butts would be approached by said electric motor.

For controlling the guiding butts it is possible to use stationary cam means instead of shaped through grooves 71, 72, 73, 91 and 92, and the corresponding chamferings for pressing them in. Thus, the independence of the means is maintained, which means that the paths of the butts are separate from one another.

LIST OF REFERENCE NUMBERS USED 1 lower needle cylinder
2 vertical trick
3 guiding sinker
4 swinging sinker
4' needle
5,6,7,8,9 cam sections
10 first sinking cam
11 second sinking cam
12 third sinking cam
13,14 channel for butts
14' shaped through groove
15,16 channeled for butts
17 push-button
18 vertical groove
19, 19',24' radially approaching push-button
24 swinging presser lever
25 carrier
26 permanent magnet
27 coil
31 joint
41 first guiding butt
42 second guiding butt
43 pattern butt
71,72,73,91,92 shaped through grooves
141' chamferings with grooves 71, 72, 73
911,922,923 chamferings with grooves 91 and 92
V choice point
S direction of knitting rotation
S' reverse knitting direction
20,21,22,23 swinging push-buttons

I claim:

1. A circular knitting machine for manufacturing hosiery comprising:

a lower needle cylinder (1) having a cam section arrangement (5, 6, 7, 8, 9) and a verticle trick (2) grooved on the needle cylinder (1) near the arrangement (5, 6, 7, 8, 9), the cam section arrangement (5, 6, 7, 8, 9) defining a plurality of channels (13, 14, 15, 16);

sinker means (3, 4) for forming a stitch and disposed in the vertical trick (2) for vertical movement in the verticle trick (2), the sinker means (3, 4) having guiding butts (41, 42) alternately engageable with the channels (13, 14, 15, 16), the guiding butts (41, 42) being movable in the channels (13, 14, 15, 16) in a knitting direction (S) and a reverse knitting direction (S');

a plurality of needles (4') engaged with the sinker means (3, 4);

stitch cams (10, 11) mounted to the cam section arrangement (5, 6, 7, 8, 9) for engaging the needles (4') when the needles (4') are moved in the knitting direction (S); and a reverse stitch cam (12) mounted to the cam section arrangement (5, 6, 7, 8, 9) for engaging the needles (4') when the needles (4') are moved in the reverse knitting direction (S').

2. The circular knitting machine according to claim 1, including shaped through grooves (71, 72, 73, 91) on the cam section arrangement (5, 6, 7, 8, 9) for receiving the guiding butt (42), the grooves (71, 72, 73, 91) having chamfering (711, 722, 733, 911) at one end of each groove for forcing the guiding butt (42) into the verticle trick (2) and a swinging push button (20, 21, 22, 23) positioned above each groove (71, 72, 73, 91) for engaging the guiding butt (41).

* * * * *